US007036342B1

(12) United States Patent
Hsieh

(10) Patent No.: US 7,036,342 B1
(45) Date of Patent: May 2, 2006

(54) YARN FEEDER

(75) Inventor: Tsung-Hung Hsieh, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 11/228,396

(22) Filed: Sep. 19, 2005

(51) Int. Cl.
*D04B 9/34* (2006.01)

(52) U.S. Cl. ..... 66/136

(58) Field of Classification Search ..... 66/125 R, 66/136, 137, 141, 111, 132, 146
See application file for complete search history.

(56) References Cited

U.S. PATENT DOCUMENTS

| | | | | |
|---|---|---|---|---|
| 2,796,752 | A * | 6/1957 | Hauberg | 66/136 |
| 3,757,537 | A * | 9/1973 | York | 66/9 R |
| 3,800,564 | A * | 4/1974 | Carswell | 66/136 |
| 4,688,401 | A * | 8/1987 | Kuhn et al. | 66/141 |
| 6,370,922 | B1 * | 4/2002 | Brach et al. | 66/136 |
| 6,386,003 | B1 * | 5/2002 | Wang | 66/136 |

FOREIGN PATENT DOCUMENTS

| | | | |
|---|---|---|---|
| TW | 394272 | A | 6/2000 |
| TW | 491300 | A | 6/2002 |
| TW | 529639 | A | 4/2003 |

* cited by examiner

*Primary Examiner*—Danny Worrell
(74) *Attorney, Agent, or Firm*—Birch,Stewart,Kolasch & Birch,LLP

(57) ABSTRACT

A yarn feeder for circular knitting machines that have a plurality of knitting needles includes a first threading hole, a second threading hole and a jutting yarn guiding member on a lower edge for feeding three yarns corresponding to a knitting needle. The three yarns enter a hook of the knitting needle through the first and second threading holes and the yarn guiding member. The hook is a common point, forms a first included angle with the yarn guiding member and the first yarn threading hole, and forms a second included angle with the first threading hole and the second threading hole. The second included angle is larger than or equal to the first included angle. Thus the three yarns can be directed smoothly into the hook of the knitting needle without forming interference. Traveling of the three yarns is smoother.

9 Claims, 4 Drawing Sheets

YARN FEEDER

FIELD OF THE INVENTION

The present invention relates to a yarn feeder for circular knitting machines and particularly to a yarn feeder to aid feeding three yarns into a circular knitting machine for a plurality of knitting needles.

BACKGROUND OF THE INVENTION

With advance of technology, nowadays filaments and fibers may be made from many different sources. Different types of yarns are being developed to give people more comfortable clothing. These days, animal furs, nylon fibers and the like are widely used in clothing fabrics. Yarns made from plant fibers also are used to make fabrics through circular knitting machines. These fabrics also are widely used to make clothes for people. Knitting of fabrics through the circular knitting machines usually requires a yarn feeder to aid yarns to be moved to a yarn hook position so that knitting needles can pick up the yarns and form loops in the knitting process. However, the yarns are often attached with floss or prone to breaking. A poorly designed yarn feeder tends to accumulate the floss or produce broken yarns. This results in lower quality of the fabrics. Or yarn threading has to be done repeatedly and results in lower production speed.

To remedy the aforesaid problems, R.O.C. patent publication No. 394272 entitled "Improved yarn feeder for knitting machines" proposes a yarn feeder which has an inclined guiding groove below a hole of the yarn feeding portion at a lower side. The hole and the guiding groove form a juncture which has a yarn guiding aperture to enable yarns to be disposed on correct positions. And two neighboring yarns are spaced from each other at a desired distance. Hence yarn feeding is smoother and yarn breaking can be reduced. But as the yarns are passing through the yarn feeder at a high speed, the yarns traveling through the inclined guiding groove incur friction due to contact and generate a high temperature. This, plus the inclined angle of the guiding groove, is prone to break the yarns. R.O.C. patent publication No. 529639 entitled "Improved yarn feeder for knitting machines" discloses a technique to overcome the problem of broken yarns mentioned above. It has a screw hole on an upper side of a yarn feeding portion of the yarn feeder to allow a bolt to fasten an auxiliary member to the yarn feeder in an inclined manner. The auxiliary member has a narrow trough on an upper portion and a yarn feeding hole on the bottom. By adjusting the fastening position of the bolt relative to the narrow trough, the angle and distance of the yarn feeding hole may be adjusted corresponding to the knitting requirements of different yarns and knitting needles. Thereby knitting operation of the yarns is steadier and smoother. The main features are the yarn feeding hole on the yarn feeder and the adjustable auxiliary member. But adjustment is difficult. And the auxiliary member is moved upwards relative to the knitting needles. As a result, the angle between the yarns is smaller. Interference frequently occurs. This generates static charge resulting from friction incurred by high speed movement between the yarn feeder and knitting needles. If the auxiliary member is moved lower relative to the knitting needle to increase the distance between the yarns, the interval of the yarn feeders has to be increased as more than one yarn feeder and knitting needle are located on the circular knitting machine. This will increase the fabrication cost. Moreover, the yarn feeding hole has a sharp edge relative to the yarn. It tends to cut off the yarn. The friction between the yarn and the hole edge also tends to accumulate floss. This will make passing of the yarn difficult when the floss is accumulated to a certain degree, and result in yarn fracturing or knitting the floss in the fabric. The finished fabric would have bumps and result in a lower fabric quality.

To remedy the aforesaid shortcomings, R.O.C. patent publication No. 491300 entitled "Improved yarn feeder for circular knitting machines" granted to the Applicant aims to eliminate floss accumulation on the yarn. It includes a jutting yarn guiding portion on another end of a yarn feeder that is formed with a smooth and curved surface. The yarn can smoothly pass through the yarn guiding portion to enter the yarn hook of the knitting needle. The yarn guiding portion is exposed, thus the floss accumulated on the yarn guiding portion can be removed easily. Moreover, the yarn feeding portion of the yarn feeder has two yarn threading holes to thread yarns. No much additional space is needed. However, the yarns are still spaced from each other at a short distance. Static charge occurs during high speed movement of the yarn. And interference takes place between the yarns during high speed movement. The yarns could even entangle with each other and result in not smooth yarn feeding operation. In short, the conventional yarn feeders previously discussed mainly have two problems: First, yarn breaking. It is mainly caused by floss accumulation, the angle of the yarn passing through the threading hole, and the friction between the yarn and the yarn feeder. Floss accumulation is caused by the characteristics of the yarn and not avoidable. However, altering the angle of the yarn passing through the yarn threading hole can reduce yarn breaking. On the other hand, while the friction cannot be totally eliminated, the friction between the yarn and the yarn feeder still can be reduced through a suitable means. Second, the problem of the interference between the yarns. This is caused by static charge resulting from friction occurred to the yarns of a too short interval moving at high speed. The yarns tend to attach to one another and result in not smooth moving. Hence increasing the interval of the yarns is a solution to overcome this problem.

SUMMARY OF THE INVENTION

Therefore the primary object of the present invention is to solve the aforesaid disadvantages. The invention provides a yarn feeder to feed three yarns for multiple knitting needles of a circular knitting machine. The yarn feeder has two yarn threading holes and a yarn guiding member corresponding to the threading positions of the tree yarns. Hence the three yarns can enter smoothly into the yarn feeder corresponding to the hook of the knitting needle to be combined into one thread without interference or entangling. The relative positions of the threading holes are changeable to increase the intervals of the three threads to achieve a steady yarn feeding.

Another object of the invention is to reduce floss accumulation while the yarns pass through the yarn feeder, and reduce thermal deformation of the thread holes. Each of the thread threading holes is coupled with a porcelain eye which is smooth and heat-resistant. This enhances the smoothness and heat resistance of the yarn threading hole.

Yet another object of the invention is to have the yarn guiding member exposed. And a detent member is provided on one end of the yarn feeder opposing another end where the yarn guiding member and the yarns are in contact. Hence in the event that the yarn is loosening off from the yarn guiding member, it is confined from escaping.

Still another object of the invention is, asides from providing two dimensional intervals among the three yarns, to include the height of the porcelain eye, or lower the elevation of the yarn threading holes to form an elevation difference between them to increase the distance of the yarns entering the yarn feeder. Thus a three dimensional interval is formed among the three yarns to reduce the interference among them.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
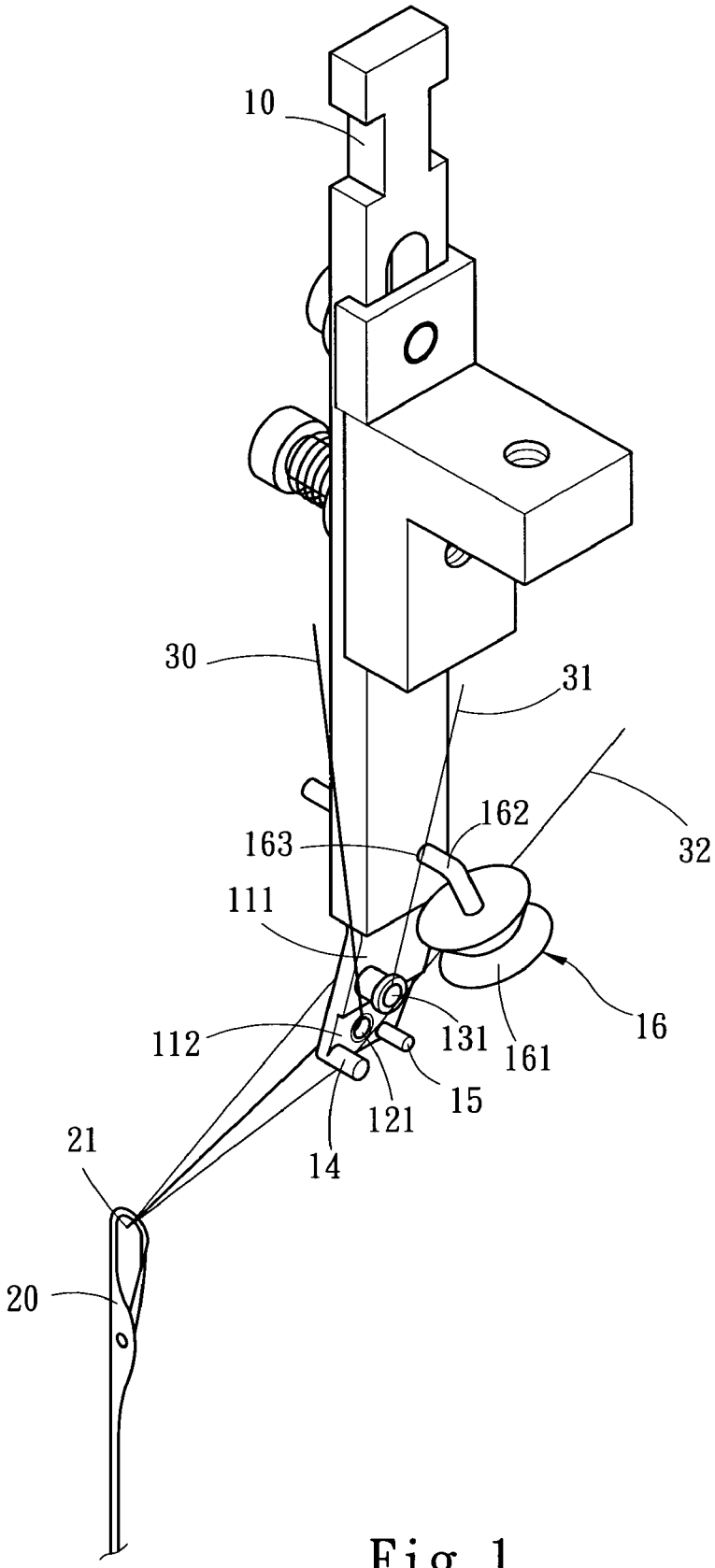
FIG. 1 is a perspective view of the present invention.

Please referring to FIG. 1, the invention includes a yarn feeder 10 located on a circular knitting machine to thread three yarns 30, 31 and 32, and feed the yarns 30, 31 and 32 to a corresponding knitting needle 20. The knitting needle 20 has a hook 21 to combine the three yarns 30, 31 and 32 into one thread.

Figure 2:
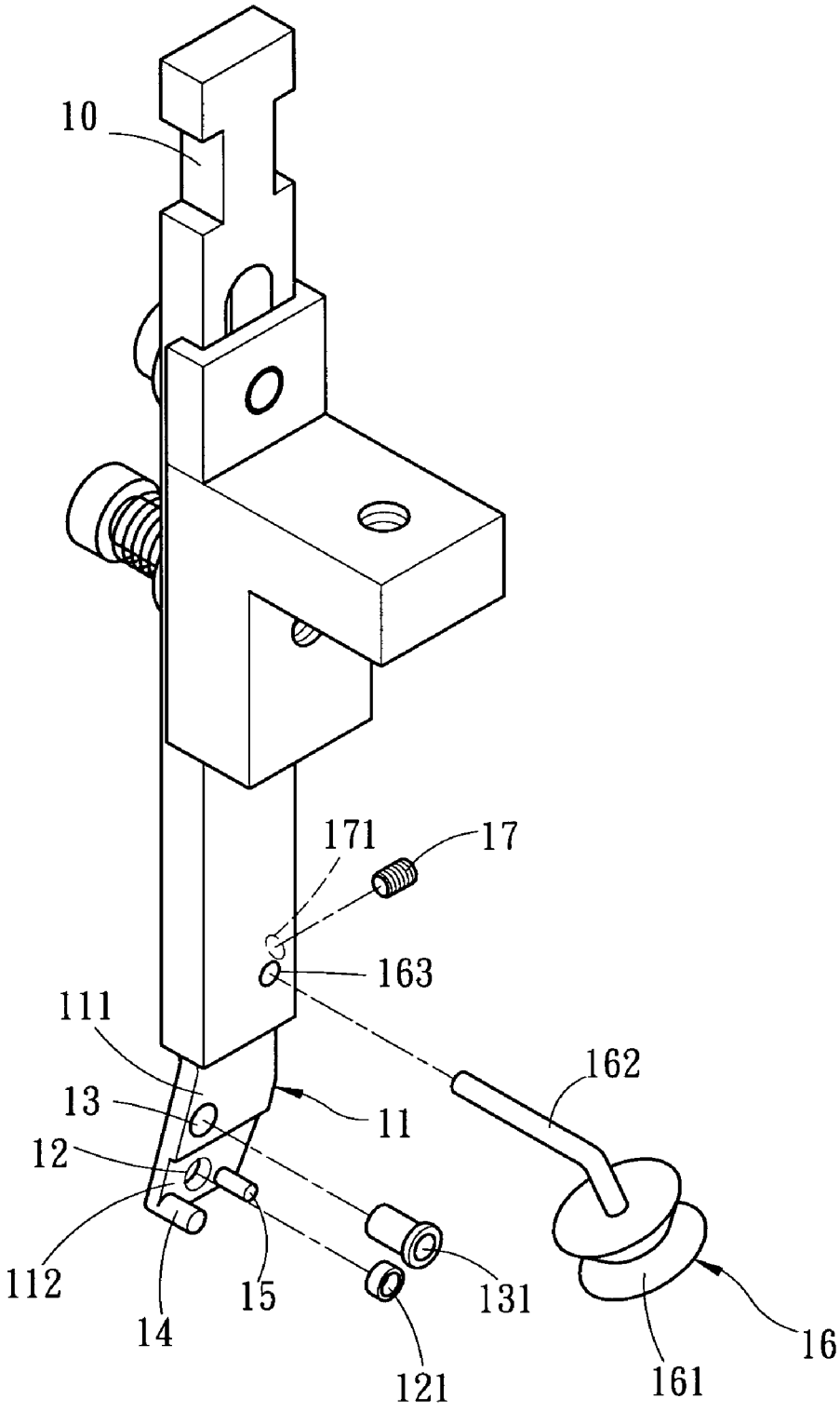
FIG. 2 is an exploded view of the present invention.
Figure 3A:
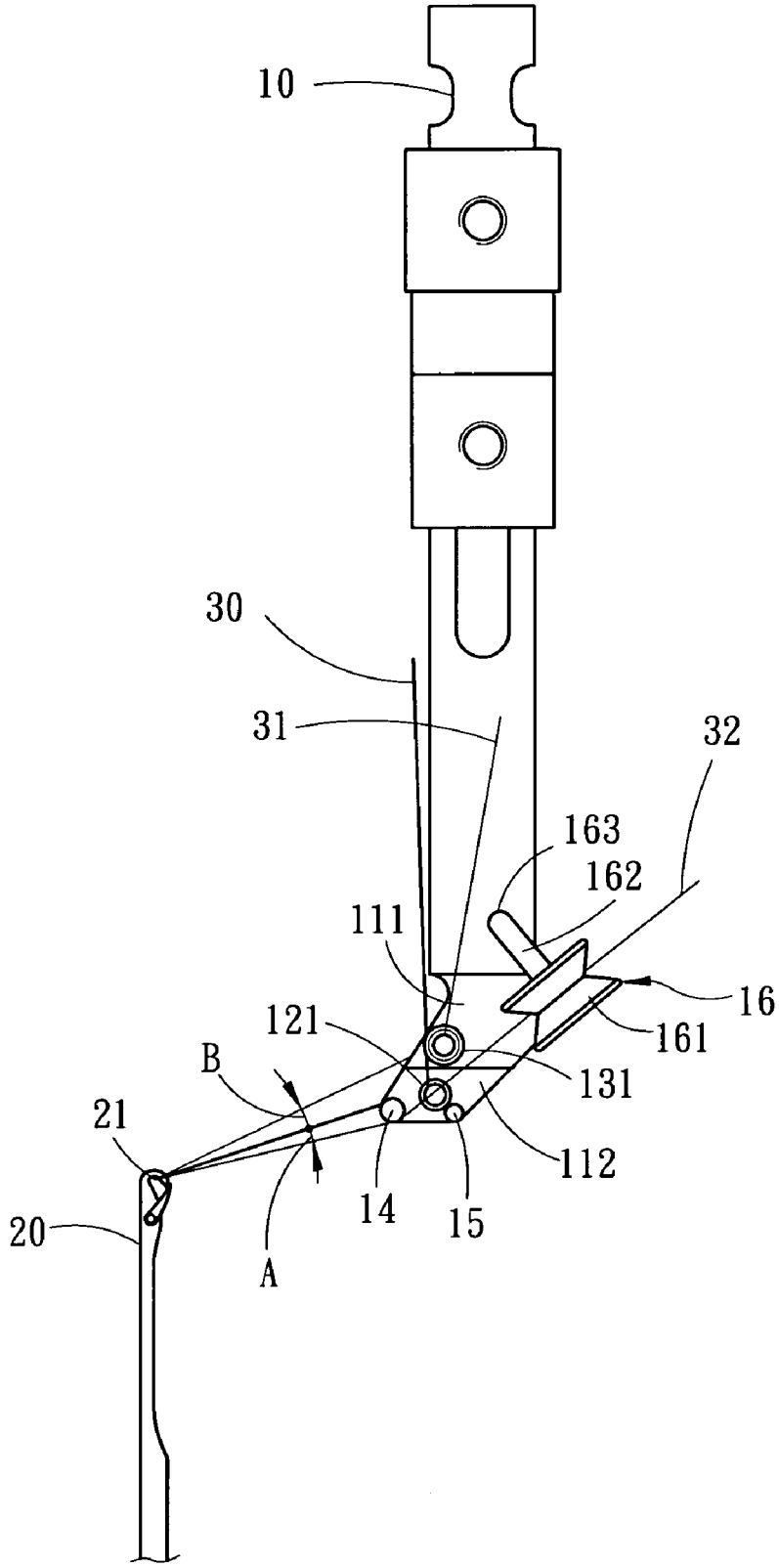
FIG. 3A is a schematic view of the invention is an assembled condition.

Referring to FIGS. 2 and 3A, the yarn feeder 10 has an indented yarn feeding portion 11 on one end opposing the knitting needle 20. The yarn feeding portion 11 has a first yarn feeding surface 111 on which the three yarns 30, 31 and 32 pass through. On the first yarn feeding surface, there are a first yarn threading hole 12, a second yarn threading hole 13 and a jutting yarn guiding member 14 on a lower end of the yarn feeding portion 11 relative to the hook 21. Through such a structure, the first yarn 30, second yarn 31 and third yarn 32 are threaded and coupled. The jutting yarn guiding member 14 locates on the lower end of the yarn feeding portion 11 correspondingly and close to the hook 21. The second yarn threading hole 13 is located above the yarn guiding member 14. The first yarn threading hole 12 is located between the second yarn threading hole 13 and the yarn guiding member 14. The hook 21 is the common point of the first yarn threading hole 12, second yarn threading hole 13 and yarn guiding member 14. The common point and the yarn guiding member 14 and the first yarn threading hole 12 form a first included angle A, the common point and the first yarn threading hole 12 and the second yarn threading hole 13 form a second included angle B. In order to prevent the thread yarns 30, 31 and 32 from interfering with one another before entering the hook 21 and avoid generating static charge, the second included angle B is preferably larger than or equal to the first included angle A. Hence before the three yarns 30, 31 and 32 enter the first yarn feeding surface 111 or the hook 21, they are paced by intervals without generating static charge. Therefore interference does not take place. According to a preferred embodiment, the first yarn feeding hole 12 may serve as the center point. The center of the second yarn threading hole 13 is located on a line vertical to the center point above the first yarn threading hole 12.

Figure 3B:
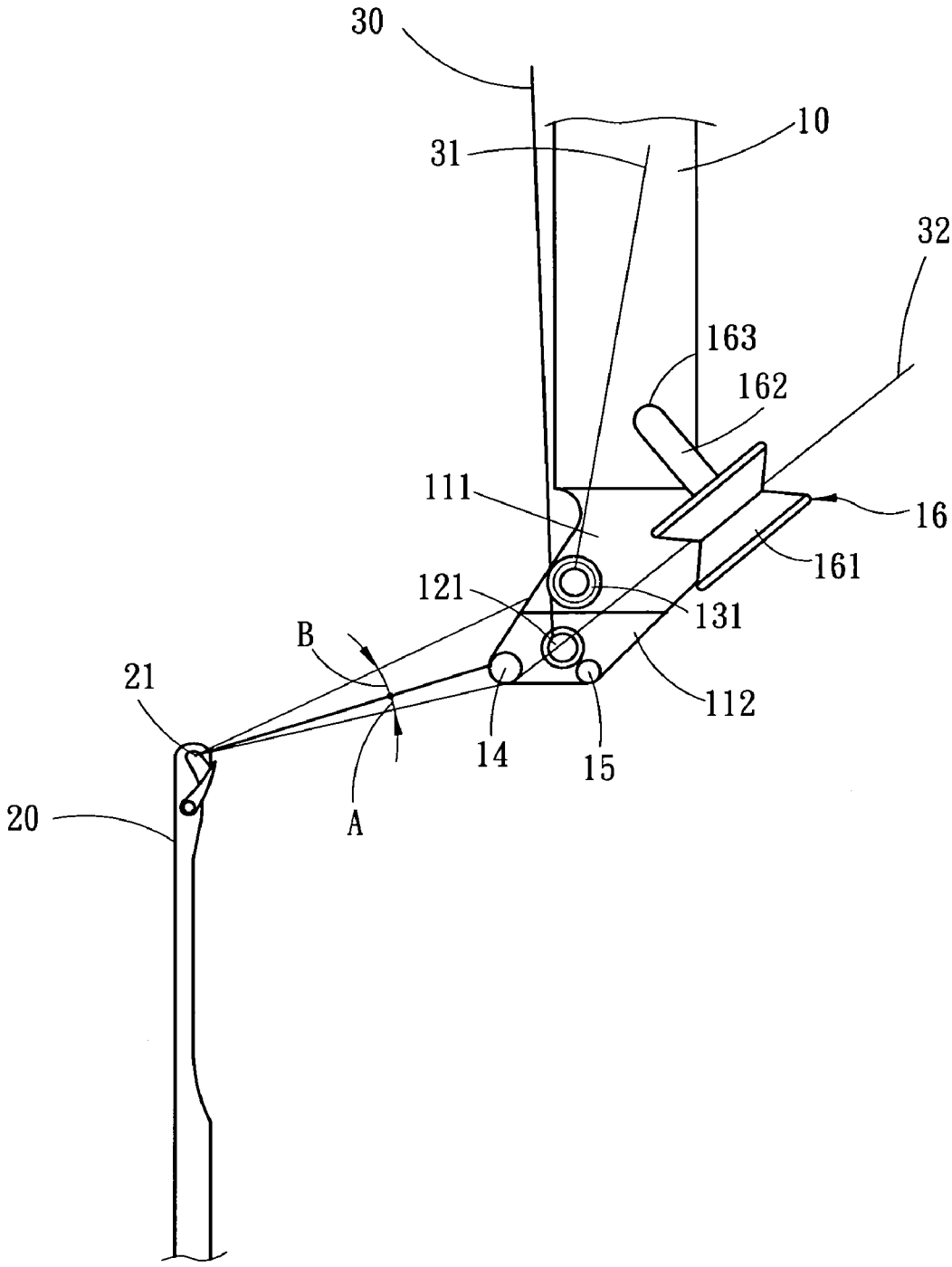
FIG. 3B is a fragmentary enlarged view of the present invention.

Referring to FIGS. 3A and 3B, in order to prevent the first and second yarn threading holes 12 and 13 from scraping and damaging the first and second yarns 30 and 31 during high speed traveling through the yarn threading holes 12 and 13 that generates high temperature which could also damage the yarn threading holes 12 and 13, and result in yarn breaking or floss accumulation, the yarn threading holes 12 and 13 are coupled respectively with a porcelain eye 121 and 131 each is formed with a curved chamfered angle and is smooth, wearing-resistant and high temperature-resistant. Hence the threads 30 and 31 can pass through the yarn thread holes 12 and 13 smoothly. In addition, the three yarns 30, 31 and 32 are spaced from one another at desired intervals, and the porcelain eye 131 of the second yarn threading hole 13 is located at a desired elevation normal to the first yarn feeding surface 111, the yarns 30, 31 and 32 form elevation differences so that they are spaced from one another in three dimensions while entering the yarn feeder 10. Similarly, the first yarn feeding surface 111 may further has an indented second yarn feeding surface 112 corresponding to the first yarn threading hole 12 to increase the elevation difference among the yarns 30, 31 and 32 and reduce the interference among them. Another way to separate the three yarns 30, 31 and 32, and generate the three dimensional interval is to increase the height of the porcelain eye 131 of the second yarn threading hole 13 and form the second yarn feeding surface 112 at a lower elevation, thereby the elevation of the first yarn threading hole 12 is lower than the second yarn threading hole 13.

Referring to FIGS. 2 and 3B, the yarn guiding member 14 is exposed outside the yarn feeding portion 11. Hence the third yarn 32 is easier to escape from the yarn guiding member 14. To prevent this from happening, there is an anchor hole 163 on a desired location of the yarn feeder 10 corresponding to the first yarn feeding surface 111 to couple with a thread guiding means 16 which has a concave portion 161 to hold the third yarn 32. The yarn guiding means is pivotally coupled with an anchor rack 162. An adjusting hole is located on another side relative to the first yarn feeding surface 111 to engage with a fastening element 17 to fasten the anchor rack 162 to the adjusting hole 171. When there is a need to thread the third yarn 32 through the guiding member 14 at different angles, unfasten the fastening element 17, and turn the thread guiding means 16 about the anchor hole 163 or normal to the first yarn feeding surface 111 to make a desired adjustment. Therefore, the third yarn 32 can smoothly pass through between the yarn guiding means 16 and the yarn feeder 10 without loosening off. Moreover, the traveling path of the third yarn 32 can be directed through the yarn guiding means 16 to the yarn guiding member 14. The position of the yarn guiding means 16 may also be altered according to the required position of the third yarn 32. Referring to FIG. 3B, to prevent the third yarn 32 from escaping after passing through the yarn guiding means 16 and resulting in loosening off, a jutting detent member 15 may be formed on a lower end of the yarn feeding portion 11 opposing the yarn guiding member 14 to confine the third yarn 32.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn feeder installed on a circular knitting machine which has a plurality of knitting needles, comprising an indented yarn feeding portion on a lower end of the yarn feeder, a first yarn threading hole and a second yarn threading hole on the yarn feeding portion, and a jutting yarn guiding member located on one end of a lower edge of the yarn feeding portion such that a first yarn, a second yarn and a third yarn enter from a first yarn feeding surface formed on one side of the yarn feeding portion, and thread through to leave via another side thereof, and are directed to a hook of a knitting needle corresponding to the yarn feeder, wherein the hook is a common point of the first yarn, the second yarn and the third yarn, and forms a first included angle with the yarn guiding member and the first yarn threading hole, and forms a second included angle with the first yarn threading hole and the second yarn threading hole, the second included angle being larger than or equal to the first included angle.

2. The yarn feeder of claim 1, wherein the first yarn threading hole and the second yarn threading hole are coupled respectively with a porcelain eye.

3. The yarn feeder of claim 2, wherein the porcelain eye on the second yarn threading hole is located at an elevation extended from the first yarn feeding surface.

4. The yarn feeder of claim 3, wherein the first yarn threading hole is located on a second yarn feeding surface which is lower than the first yarn feeding surface.

5. The yarn feeder of claim 1, wherein the first yarn threading hole is located on a second yarn feeding surface which is lower than the first yarn feeding surface.

6. The yarn feeder of claim 1 further including a yarn guiding means to aid threading of the third yarn, an anchor rack pivotally coupled on the yarn guiding means, and an anchor hole to hold the anchor rack.

7. The yarn feeder of claim 6 further having an adjusting hole on another side relative to the anchor hole to engage with a fastening element to fasten the anchor rack of the yarn guiding means.

8. The yarn feeder of claim 6, wherein the yarn guiding means has a concave portion to hold the third yarn.

9. The yarn feeder of claim 1, wherein the yarn feeding portion has a jutting detent member on another end of the lower edge opposing the yarn guiding member.

* * * * *